US012379168B2

(12) United States Patent
Bova et al.

(10) Patent No.: US 12,379,168 B2
(45) Date of Patent: Aug. 5, 2025

(54) RECOIL BRACKET FOR A HANDGUN

(71) Applicant: Sig Sauer, Inc., Newington, NH (US)

(72) Inventors: Chris Bova, Barrington, NH (US); Jarrod Lemire, Atkinson, NH (US)

(73) Assignee: Sig Sauer, Inc., Newington, NH (US)

( * ) Notice: Subject to any disclaimer, the term of this patent is extended or adjusted under 35 U.S.C. 154(b) by 0 days.

(21) Appl. No.: 18/530,804

(22) Filed: Dec. 6, 2023

(65) Prior Publication Data

US 2024/0191956 A1 Jun. 13, 2024

Related U.S. Application Data

(60) Provisional application No. 63/386,575, filed on Dec. 8, 2022.

(51) Int. Cl.
*F41A 3/66* (2006.01)
*F41C 23/10* (2006.01)

(52) U.S. Cl.
CPC ..... *F41A 3/66* (2013.01); *F41C 23/10* (2013.01)

(58) Field of Classification Search
CPC ..... F41A 3/66; F41A 3/86; F41A 5/14
See application file for complete search history.

(56) References Cited

U.S. PATENT DOCUMENTS

2020/0025470 A1* 1/2020 Patrick, IV ..... F41C 23/16

OTHER PUBLICATIONS

Shianigunz, "Sig Sauer P365XL Mischief Machine Omega Aluminum Grip Module Review" available at https://www.youtube.com/watch?v=Zml_pvEcPS4 (Mar. 11, 2022).

* cited by examiner

*Primary Examiner* — J. Woodrow Eldred
(74) *Attorney, Agent, or Firm* — Finch & Maloney PLLC

(57) ABSTRACT

A handgun grip module assembly includes a grip module with a handgrip portion, a slide portion, and a trigger guard extending between and connecting the handgrip portion to the slide portion. The slide portion extends longitudinally along a central axis and has opposed sidewalls and a bottom wall. The slide portion defines a bracket recess in the bottom wall and defines a receiver well between the opposed sidewalls and above the handgrip portion. A recoil bracket is movably disposed in the bracket recess. In some examples, the grip module can be made of a metal or a metal-infused polymer. During use, the recoil bracket can move in response to forces exerted on it during the firing cycle.

20 Claims, 7 Drawing Sheets

RECOIL BRACKET FOR A HANDGUN

RELATED APPLICATIONS

This application claims the benefit under 35 U.S.C. § 119(e) of U.S. Provisional Patent Application No. 63/386,575, titled RECOIL BRACKET FOR A HANDGUN, and filed on Dec. 8, 2022, the contents of which are incorporated herein by reference in its entirety.

FIELD OF THE DISCLOSURE

This disclosure relates to firearm assemblies and more particularly to a recoil bracket for a handgun.

BACKGROUND

Traditionally, handguns have included a metal frame to which additional components are attached using pins or fasteners, such as the fire control group, safety levers, and grip panels. More recently, some handguns have a polymeric grip module that houses a metal receiver and components of the fire control group. The recoil assembly, which includes the slide, barrel, and a recoil spring, is mounted on rails that extend along the top of the receiver such that the slide can reciprocate during the firing cycle. When a semiautomatic handgun is fired, the slide returns rearward to cycle the action. In doing so, the slide's dust cover contacts a recoil lug in the grip module and transfers recoil forces to the receiver and on to the shooter's hand via the grip module. For recoil-operated handguns, the barrel also moves rearward and stops abruptly on the takedown lever, slide stop, or receiver. The takedown lever or slide stop and recoil lug transfer recoil force to the receiver and grip module.

SUMMARY

One aspect of the present disclosure is directed to a handgun grip module with a metal recoil lug that is movably retained in the slide portion of the grip module. In one example, the grip module is made of aluminum, an aluminum alloy, a metal-infused polymer. For example, the polymer is infused with steel brass, and/or tungsten. The recoil lug is movably retained in contact with or closely adjacent the distal end of the receiver. The recoil lug can be made of metal, such as aluminum, an aluminum alloy, steel, titanium, brass, or tungsten. When the gun is fired, the recoil lug can move rearward against the receiver and slightly upward at the point of contact between the lug and the receiver, followed by returning to the resting position at the end of the firing cycle. In contrast to a lug that is fixedly retained to the grip module by way of fasteners, this movement in the recoil lug better transfers forces and distributes recoil forces to a greater portion of the grip module. Accordingly, the recoil lug permits a smaller contact surface and a greater working clearance, features which are particularly helpful in a compact modular handgun. In accordance with some embodiments, the recoil lug exhibits an extended life compared to those that are fixed in the grip module by fasteners or the like.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the disclosed subject matter.

Figure 1A:
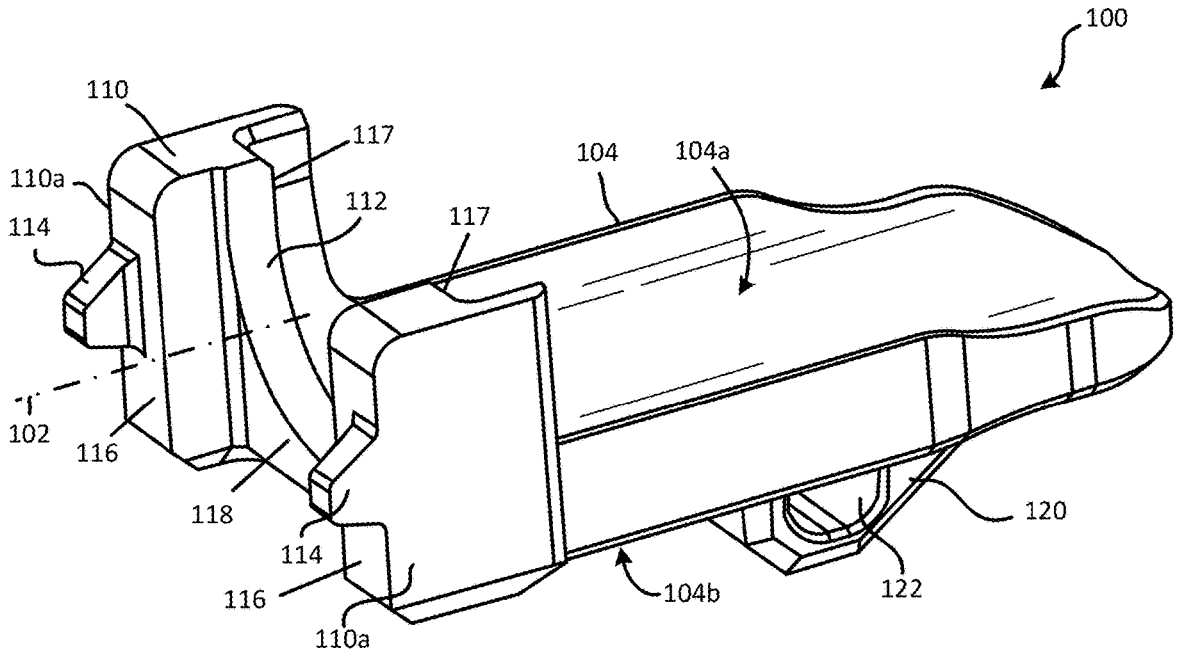
FIG. 1A illustrates a front and side perspective view of a recoil bracket, in accordance with an embodiment of the present disclosure.

These and other features of the present embodiments will be better understood by reading the following detailed description, taken together with the Figures herein described. For purposes of clarity, not every component may be labeled in every drawing. Furthermore, as will be appreciated, the figures are not necessarily drawn to scale or intended to limit the present disclosure to the specific configurations shown. In short, the Figures are provided merely to show example structures.

DETAILED DESCRIPTION

Components of a handgun assembly are disclosed. In accordance with some embodiments of the present disclosure, a handgun grip module has a recoil lug movably retained in the grip module. For example, the recoil lug is positioned closely adjacent to or in contact with a distal end of the receiver. The recoil bracket can include one or more protrusions or "teeth" that engage the distal end of the frame. In use, the recoil bracket can move in response to various forces exerted on it during the firing cycle.

Some embodiments of a handgun grip module and handgun assembly of the present disclosure advantageously better distribute recoil energy to larger regions of the grip module. Accordingly, contact surfaces on the recoil lug can be reduced and in turn increase clearance within the handgun. The ability of the recoil bracket to move can also provide an extended service life of the handgun components, in accordance with some embodiments. While the advantages of the recoil lug are particularly applicable to compact handguns, a recoil lug in accordance with the present disclosure can be configured for use in compact and full-size handguns alike. Numerous configurations and variations will be apparent in light of this disclosure.

As discussed herein, terms referencing direction, such as upward, downward, vertical, horizontal, left, right, front, back, etc., are used for convenience to describe embodiments as conventionally oriented and as shown in the figures. Embodiments according to the present disclosure are not limited by these directional references and it is contemplated that a handgun, grip module, and other components discussed herein could be used in any orientation.

General Overview

As noted above, non-trivial issues arise that complicate weapons design and performance of semiautomatic handguns. During the firing cycle of a handgun, several events (firing, unlocking, slide travel, locking, etc.) transmit loads from the working parts (barrel, slide, recoil spring, etc.) to parts interfaced by the operator (receiver, grip module, grip panels, etc.). The duration and magnitude of these loads impose constraints on the materials of these parts as well as on the size of the contact surface and on clearances.

Traditionally, the recoil energy of a semiautomatic handgun is absorbed primarily through the takedown lever, slide stop, or receiver and transmitted to the grip. The shooter feels recoil force upon firing the gun when the slide and barrel move rearward, followed by the dust cover at the distal end of the slide moving rearward and stopping against the recoil lug. The barrel also transfers recoil force to the frame as it moves rearward and stops abruptly on the takedown lever, slide stop, or receiver. In the case of a polymer grip module, a recoil lug can be embedded into the grip module to reinforce the polymer material and to distribute recoil forces more evenly to the grip module.

To add mass to a polymer-framed handgun, which can reduce felt recoil forces and may improve sight acquisition on follow-up shots, some semiautomatic handguns can have a metal grip module that accepts the receiver in the same way as the polymer grip module. For example, the grip module is made of aluminum. In some existing metal grip modules, the recoil lug and grip module are a single, monolithic structure. However, a full-size aluminum frame may already be the smallest size without either having a reduced product life or an added steel recoil insert. Thus, the metal grip modules of compact handguns may employ a steel insert that is secured into the grip module using fasteners. Metal grip modules having an integral recoil lug have exhibited early failure, such as the recoil lug cracking adjacent the receiver. In other designs, the recoil lug is fixedly retained in the grip module using screws. The fixed recoil lug attempts to solve the problem of early failure seen in monolithic designs. However, such designs exhibit failure at the screws and associated threaded bores. In many cases, failure at the recoil lug or threaded bores typically requires replacing the entire grip module since repairing this failure is unlikely to be cost effective.

Thus, a need exists for an improved recoil lug for a compact modular handgun that satisfies demands for reliability and durability. The present disclosure addresses this need and others by providing a recoil lug that is movably installed in the grip module. A movable recoil lug relaxes size and clearance constraints to permit the use of smaller contact surfaces and larger working clearances. In some embodiments, the movable recoil lug, or recoil bracket, is provided with a metal grip module. For example, the grip module can be made of aluminum or an aluminum alloy. In other embodiments, the grip module can be made of a polymer infused with steel, brass, and/or tungsten, for example. In one such embodiment, the polymer includes metal particles distributed through the polymer material; in other embodiments, the grip module includes metal inserts such as rods or blocks.

As will be appreciated in light of this disclosure, a grip module with movable recoil bracket can be used in a semiautomatic handgun of any size and having either striker-fired or hammer-fired action. In accordance with some example embodiments, a grip module with a movable recoil bracket is provided as part of a semiautomatic handgun of compact size, such as one having a barrel length no greater than 4 inches, no greater than 3.5 inches, no greater than 3.25 inches, or no more than 3 inches. Other suitable host firearms and chamberings will be apparent in light of this disclosure.

While generally referred to herein as a recoil bracket for consistency and ease of understanding the present disclosure, the disclosed recoil bracket is not limited to that specific terminology and alternatively can be referred to, for example, as a recoil lug, a metallic bracket, a metal insert, a frame insert, or other terms. As will be further appreciated, the particular configuration (e.g., materials, dimensions, etc.) of a recoil bracket configured as described herein may vary, for example, depending on whether the intended use is military, tactical, or civilian in nature. Numerous configurations will be apparent in light of this disclosure.

Structure and Operation

Figure 1B:
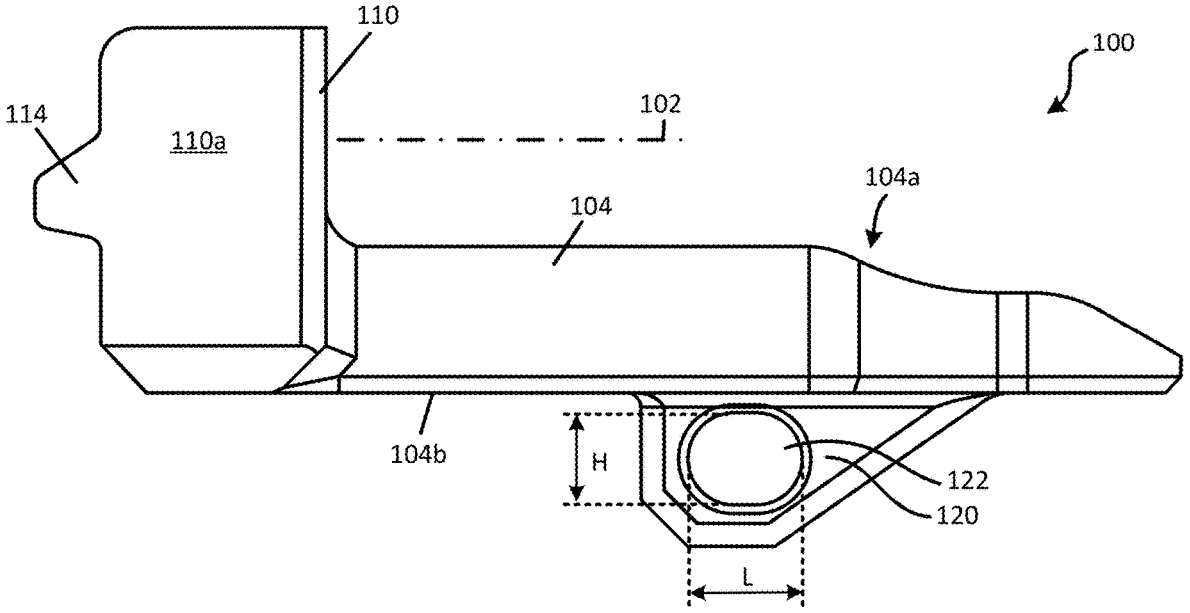
FIG. 1B illustrates a side view of the recoil bracket of FIG. 1A.

FIGS. 1A and 1B illustrate a front perspective view and a side view, respectively, of a recoil bracket 100, in accordance with an embodiment of the present disclosure. The recoil bracket 100 includes a body 104 that is elongated along a central axis 102. When installed in the firearm, the central axis 102 is parallel to or coincident with the bore axis of the barrel. The body 104 has a top surface 104*a* and a bottom surface 104*b*. A lug 110 at a distal end of the body 104 extends upward and defines a central opening 112 sized to receive the barrel therethrough. In some embodiments, the top surface 104*a* has an arcuate profile, such as having a radius of curvature consistent with or equal to that of the barrel outer surface. Further, the central opening 112 can be semicircular with a radius of curvature matching that of the barrel outer surface. Such curved features can facilitate proper alignment of the barrel during the firing cycle. In other embodiments, the top surface 112*a* can be planar and/or the central opening 112 can have a rectangular or other geometry.

The lug 110 includes lateral posts 116 extending upward and a bridge 118 extending between and connecting them. A distal portion of each lateral post 116 is recessed to define an impact surface 117 for the slide's dust cover. In this example, the bridge 118 has an arcuate shape that extends between and connects the lateral posts 116. The bridge 118 can have a reduced axial thickness compared to the lateral posts 116. A tooth 114 extends distally from each lateral post 116. Each tooth 114 can have a generally triangular geometry, such as a trapezoidal or a triangular shape. The teeth 114 are shaped to be received in corresponding recesses 304 in the receiver 300 (shown in FIG. 7). In this example, each tooth 114 is positioned along an outer margin of the lug 110 and is flush with an outer lateral face 110*a* of the lug 110.

The recoil bracket 100 of FIGS. 1A-1B includes an eye 120 on the bottom of the body 104, the eye 120 defining a through opening 122 for a pin or fastener. As shown, the through opening 122 has an elongated shape along the central axis 102 so as to permit axial movement of the recoil bracket 100. For example, a height H of the through opening 122 is from 50-95%, or about 80%, of an axial length L of the through opening 122. After placing the recoil bracket 100 in the grip module 200, a pin can be installed through the eye 120 to retain the recoil bracket 100.

Figure 2A:
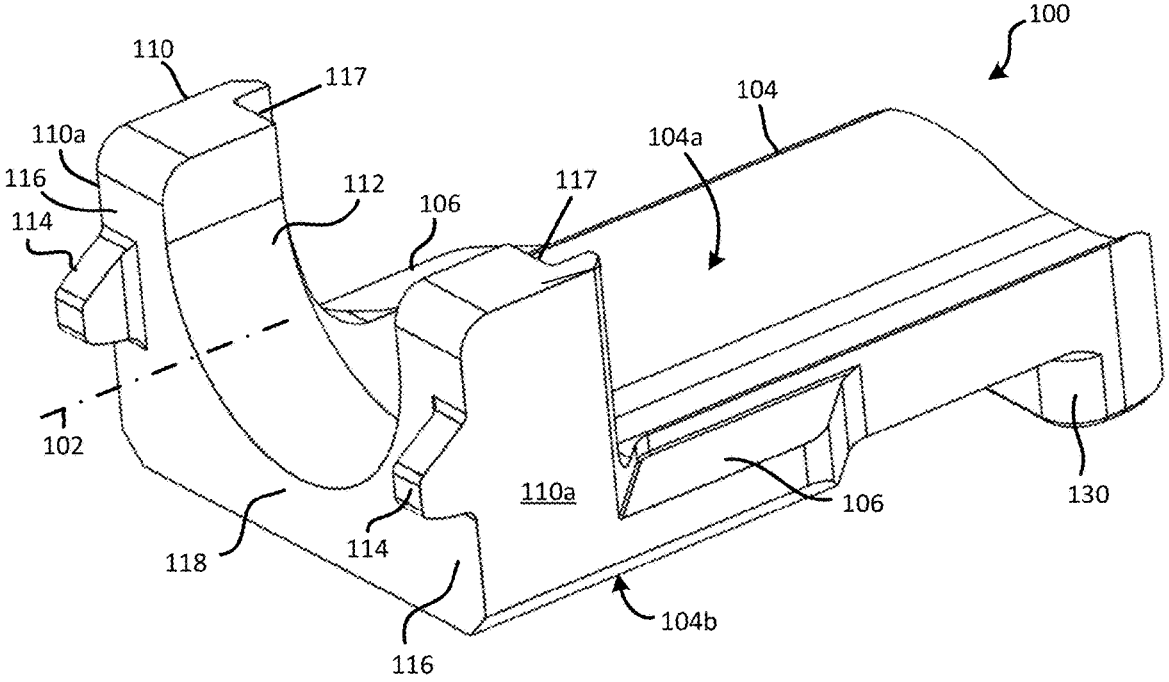
FIG. 2A illustrates a front and side perspective view of a recoil bracket, in accordance with another embodiment of the present disclosure.
Figure 2B:
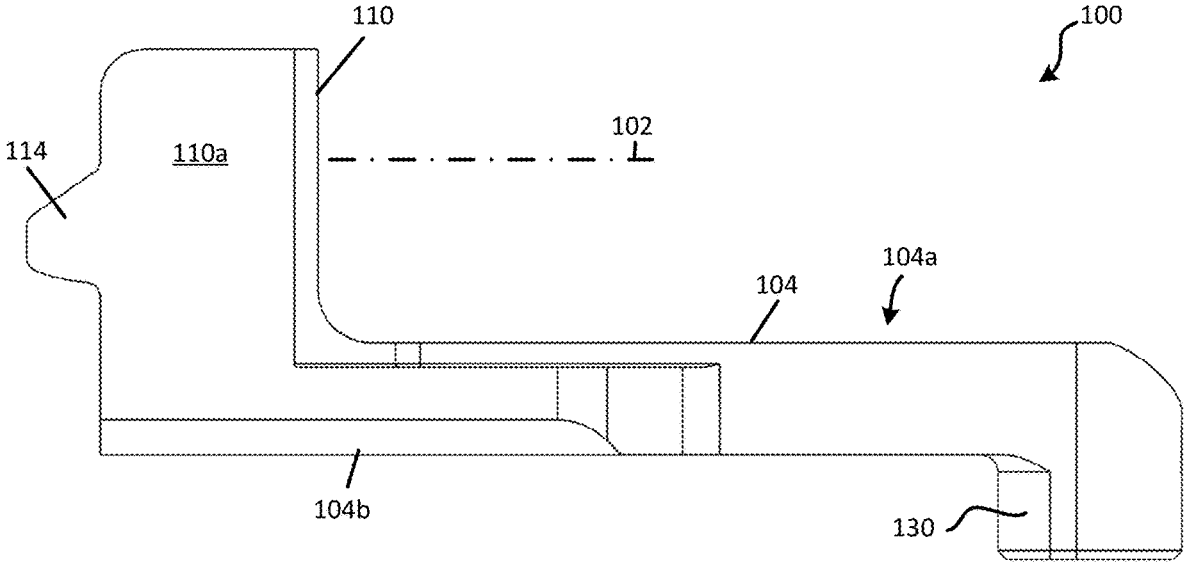
FIG. 2B illustrates a side view of the recoil bracket of FIG. 2A.

FIGS. 2A and 2B illustrate a front perspective view and a side view, respectively, of a recoil bracket 100, in accordance with another embodiment of the present disclosure. Similar to the embodiment discussed above, the recoil bracket 100 includes a body 104 that is elongated along the central axis 102 and has a top surface 104*a* and a bottom surface 104*b*. A lug 110 at a proximal end of the body 104 extends upward and defines a central opening 112 sized to receive the barrel therethrough. The top surface 104*a* has an arcuate profile, such as having a radius of curvature consistent with or equal to that of the barrel outer surface. The central opening 112 is generally semicircular with a radius of curvature matching that of the barrel outer surface. When assembled with the barrel and slide, the barrel can contact the top surface 104*a* as it extends through the central opening 112. Note in this example that the arcuate top surface 104*a* has a lateral width about equal to that of the central opening 112 through the lug 110.

On each side of the body 104 is a shelf or wing 106 that extends laterally outward from the body 104. For example, each wing 106 extends laterally to the same extent as the lug 110 and shares an outer lateral face 110*a* with the lug 110. In this example, each wing 106 has a vertical thickness that is less than that of the body 104. In use, each wing 106 is received in a recess or slot in the grip module (e.g., shown in FIG. 5). Each wing 106 transmits upward or downward force to the grip module 200 during the firing cycle.

As with the embodiment discussed above, the lug 110 includes lateral posts 116 extending upward, and a bridge 118 extending between and connecting the lateral posts 116. The bridge 118 has an arcuate top surface that defines the central opening 112, at least in part. A distal portion of each lateral post 116 is recessed to define an impact surface 117 for the slide's dust cover. The bridge 118 generally has the same axial thickness as part of the lateral posts 116. A tooth 114 extends distally from each lateral post 116. The teeth 114 are shaped to be received in corresponding recesses in the receiver. In this example, each tooth 114 is positioned along the lateral margin of the respective lateral post 116 and is flush with an outer lateral face 110*a* of the lug 110.

The recoil bracket 100 of FIGS. 2A-2B includes a foot 130 that extends down from the bottom surface 104*b* at a proximal end of the body 104. The foot 130 can be received in a corresponding pocket or foot recess 210 defined in the slide portion of the grip module 200. As such, the foot 130 can guide axial movement of the recoil bracket 100 as well as transfer force to the grip module 200. As shown in this example, the foot 130 has the same lateral width as the body 104. In other embodiments, the foot 130 can have a different lateral width compared to the body 104 and/or can be located at other locations along the body 104.

Figure 3:
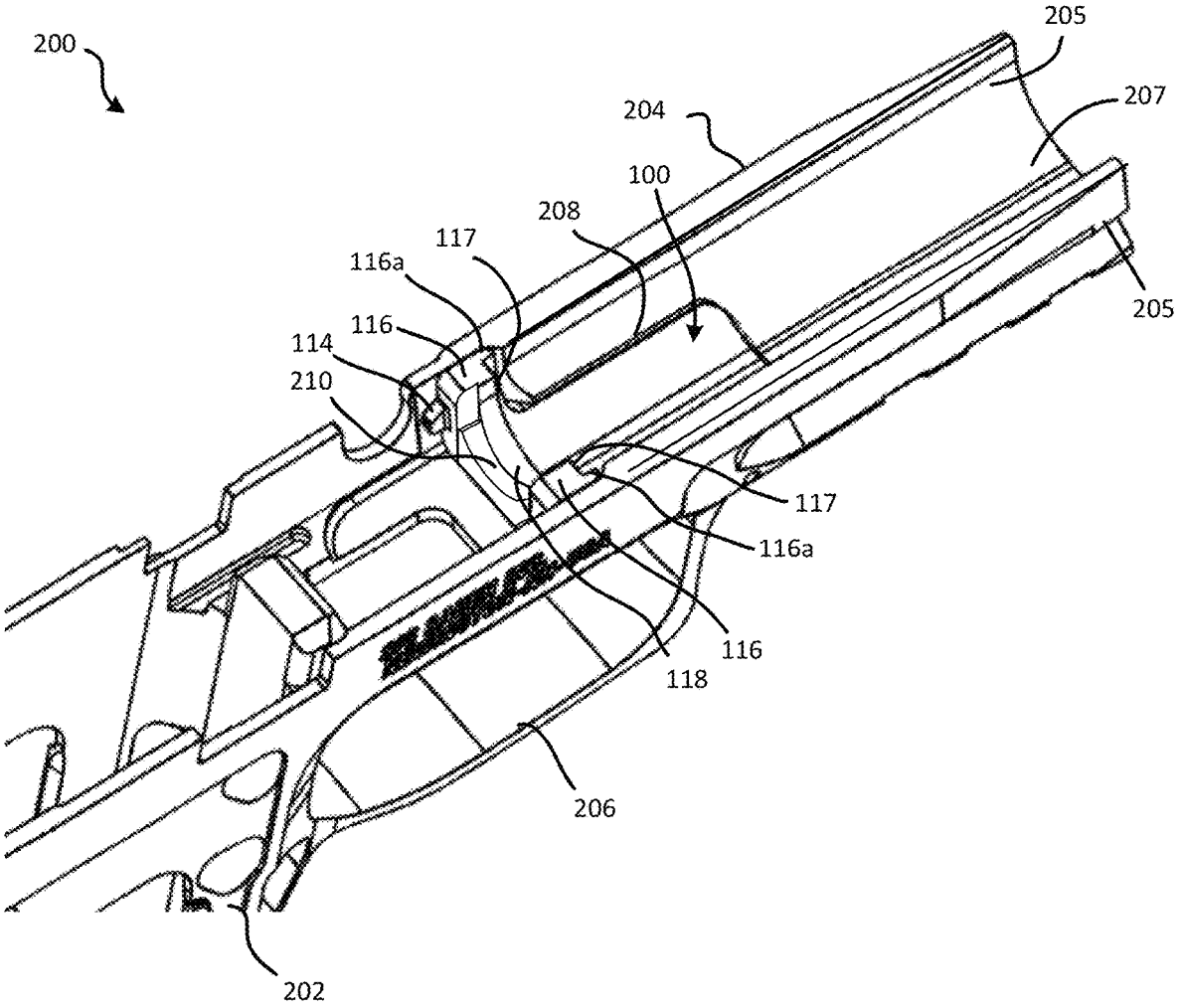
FIG. 3 illustrates a top perspective view of a handgun grip module with an installed recoil bracket, in accordance with an embodiment of the present disclosure.

FIG. 3 illustrates a top perspective view showing part of a grip module 200 with an installed recoil bracket 100, in accordance with an embodiment of the present disclosure. The grip module 200 includes a grip portion 202, a slide portion 204, and a trigger guard 206. An inside of the slide portion 204 defines a recess 208 in the bottom wall 207 and sidewalls 205. In some embodiments, the recess 208 has the same geometry as the body 204 or a portion thereof. The recess 208 extends into the sidewalls to accommodate outer portions 116*a* of the lateral posts 116 of the lug 110. The impact surface 117 extends laterally inward from the sidewalls of the slide portion 204.

In its installed position as shown, for example, the bridge 118 of the lug 110 abuts a barrel rest 210 that is part of the grip module 200. The barrel rest 210 extends up between the lateral posts 116 and is flush along its top surface with the top of the bridge 118. In other embodiments, the barrel rest 210 is omitted and can be replaced by a bridge 118 of increased axial thickness, such as shown in the recoil bracket of FIGS. 2A-2B.

Figure 4:
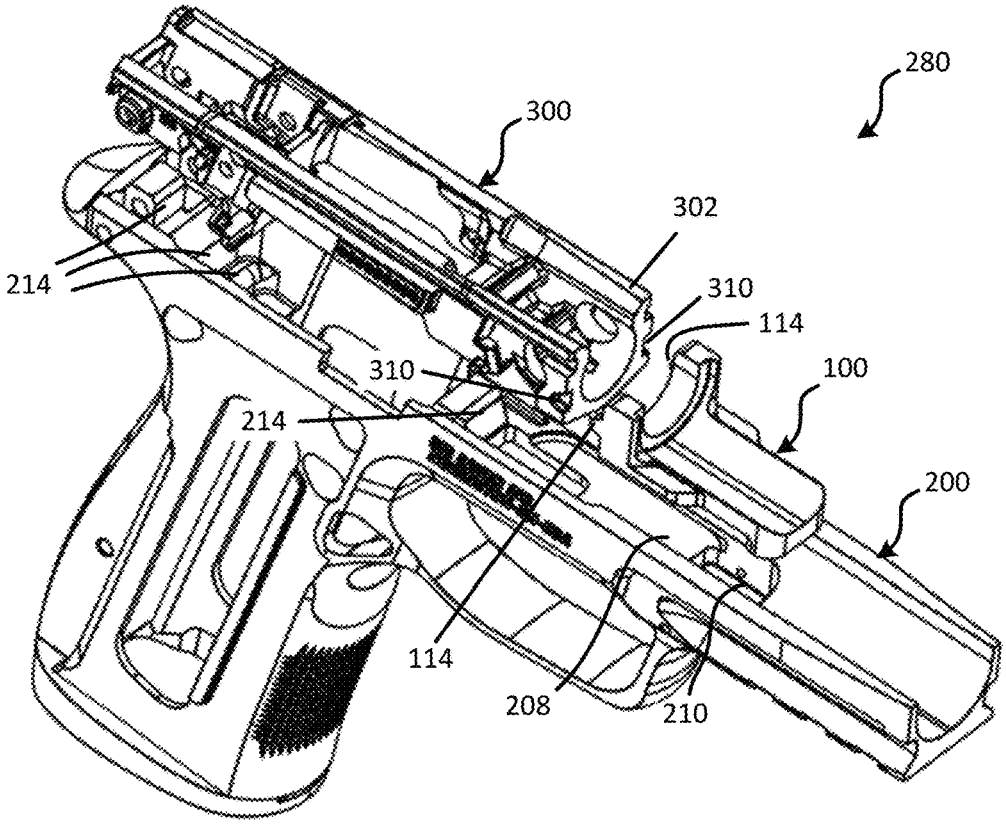
FIG. 4 illustrates an exploded, top, front, and side perspective view showing a grip module, recoil bracket, and receiver of a firearm subassembly, in accordance with an embodiment of the present disclosure.
Figure 5:
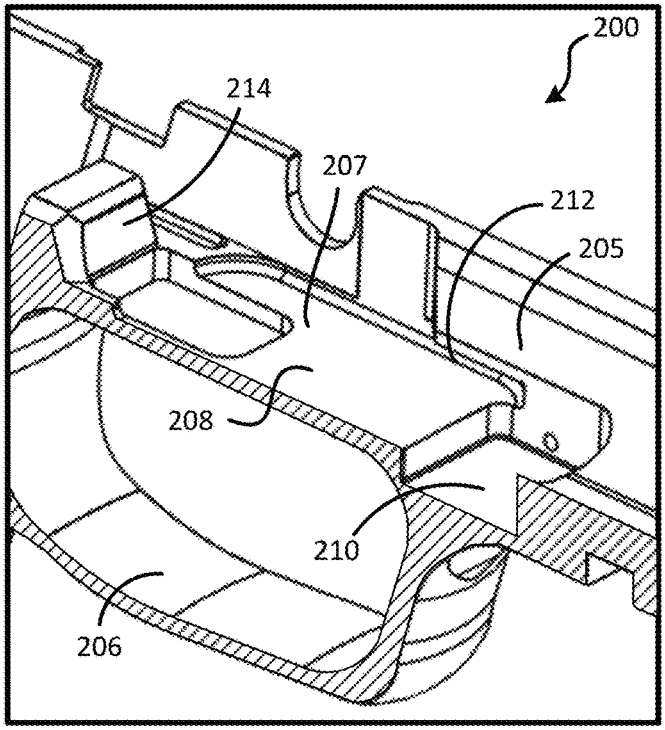
FIG. 5 illustrates a front and side perspective view showing part of the grip module of FIG. 4 sectioned longitudinally to reveal the bracket recess, in accordance with an embodiment of the present disclosure.

FIG. 4 illustrates an exploded, isometric view of a firearm subassembly 280 that includes a grip module 200, a recoil bracket 100, and a receiver 300, in accordance with an embodiment of the present disclosure. FIG. 5 shows a close-up, longitudinal section of part of the grip module 200. As noted above, the receiver 300 and recoil bracket 100 can be installed in the grip module 200 with teeth 114 received in tooth recesses 304 at the distal end 302 of the receiver 300. In the installed condition, the recoil bracket 100 abuts or is positioned closely adjacent to the distal end 302 of the receiver 300. Contact between the distal end 302 of the receiver and the proximal face of the recoil bracket 100 may be discontinuous throughout the firing cycle, as will be appreciated. The grip module 200 includes a plurality of load bearing surfaces 214 that contact the receiver 300 during the firing cycle. The foot 130 is received in a foot recess 210 that is part of the recess 208 for the recoil bracket 100. As best seen in FIG. 5, the recess 208 includes a slot or undercut 212 between the bottom wall 207 and each sidewall 205, the undercut 212 sized to receive a wing 106 of the recoil bracket 100.

Figure 6:
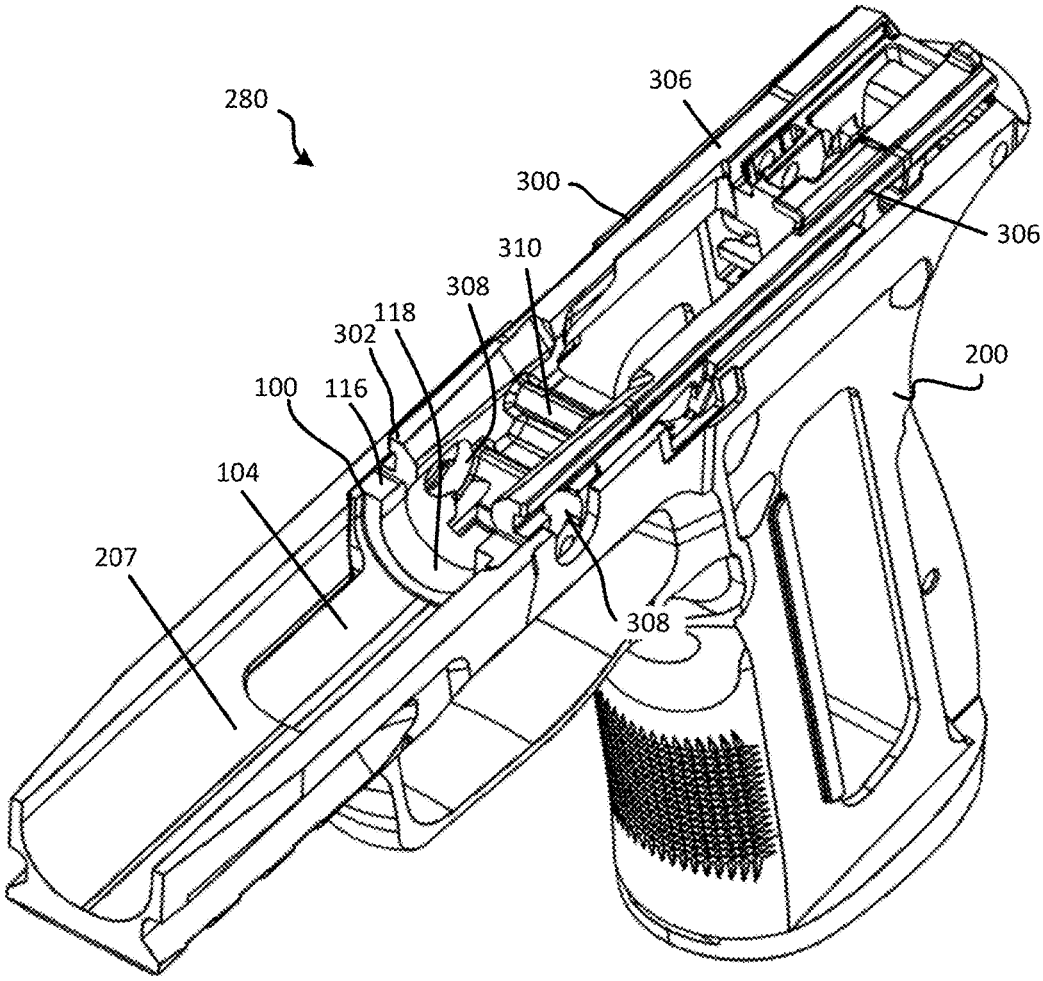
FIG. 6 illustrates a top, side, and front perspective view showing a firearm subassembly with the recoil bracket and receiver installed in the grip module, in accordance with an embodiment of the present disclosure.
Figure 7:
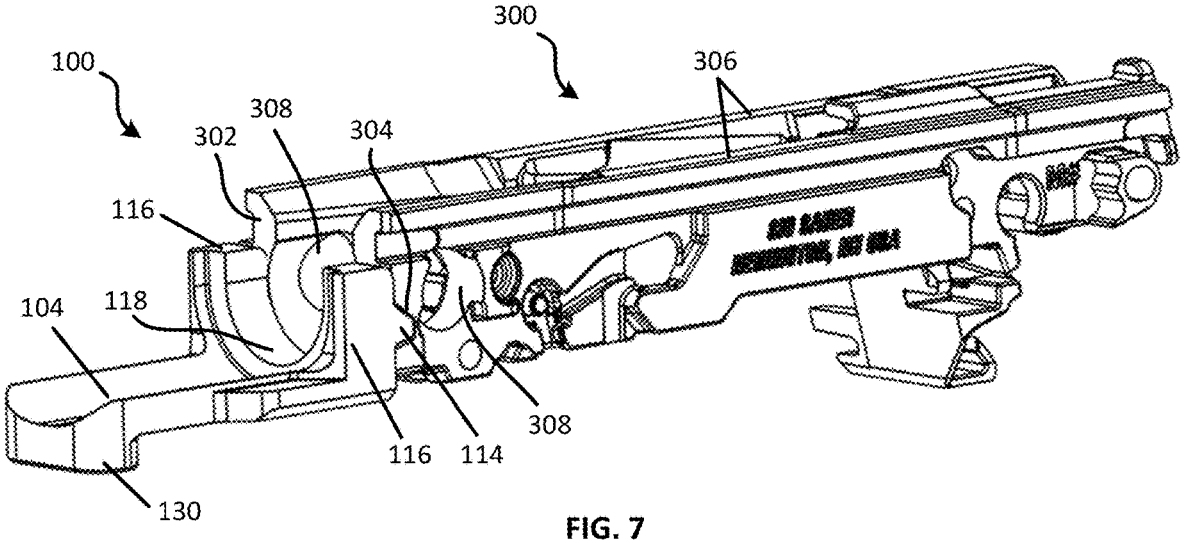
FIG. 7 illustrates a front perspective view showing a recoil bracket and receiver in an assembled position, in accordance with an embodiment of the present disclosure.

FIG. 6 illustrates a top and front perspective view of the firearm subassembly 280 of FIG. 4 and shows the grip module 200 with the receiver 300 and recoil bracket 100 installed, in accordance with an embodiment of the present disclosure. FIG. 7 illustrates a front perspective view of a recoil bracket 100 and receiver 300 in assembled form. In FIG. 6, the body 104 of the recoil bracket 100 is flush or substantially flush with the bottom wall 207 of the grip module 200. In both FIGS. 6-7, the lateral posts 116 and bridge 118 contact the distal end 302 of the receiver 300 with the teeth 114 received in the corresponding tooth recesses 304.

The receiver 300 includes rails 306 that extend axially along the top of the receiver 300 and are elevated above the recoil bracket 100. The receiver 300 defines a takedown lever opening 308. A barrel lug 310 extends crosswise between opposite sides of the receiver 300.

Figure 8:
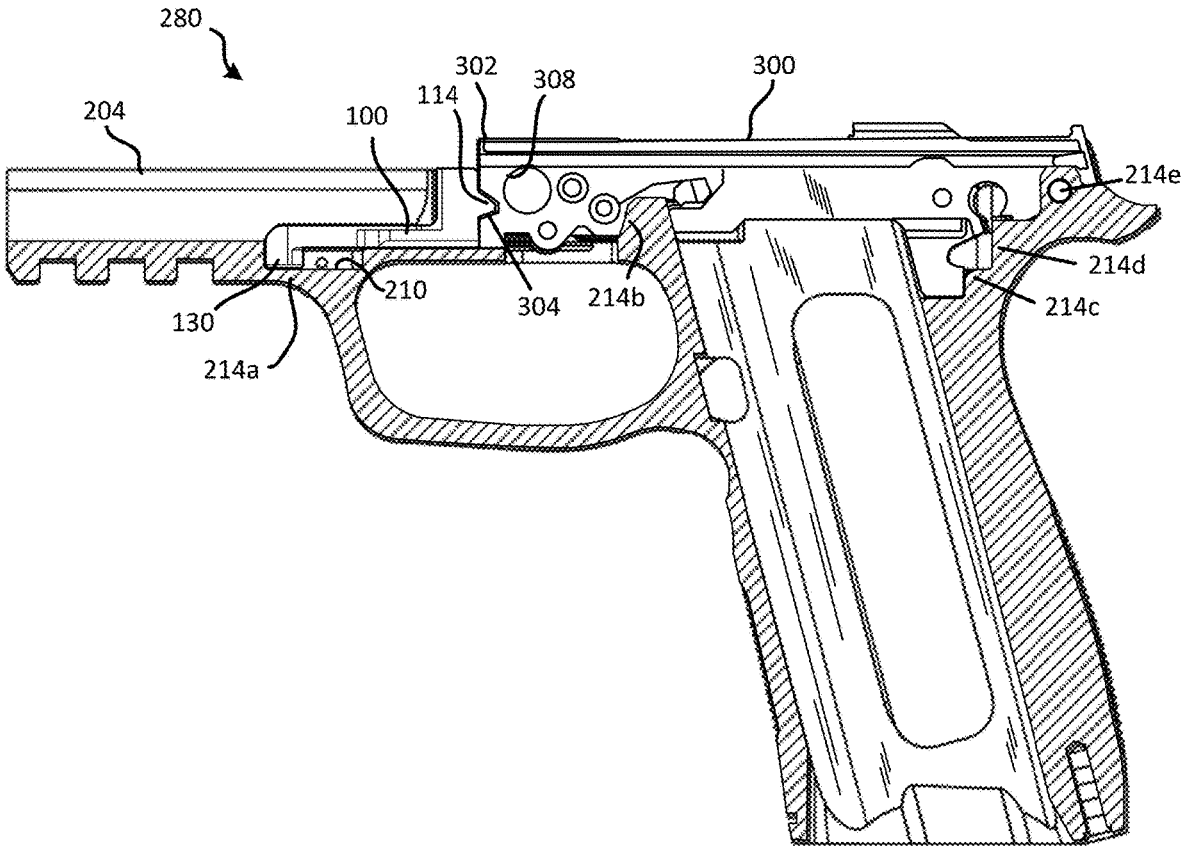
FIG. 8 illustrates a side, partial cross-sectional view of a firearm subassembly, showing the recoil bracket and receiver installed in the grip module, in accordance with an embodiment of the present disclosure.
Figure 9:
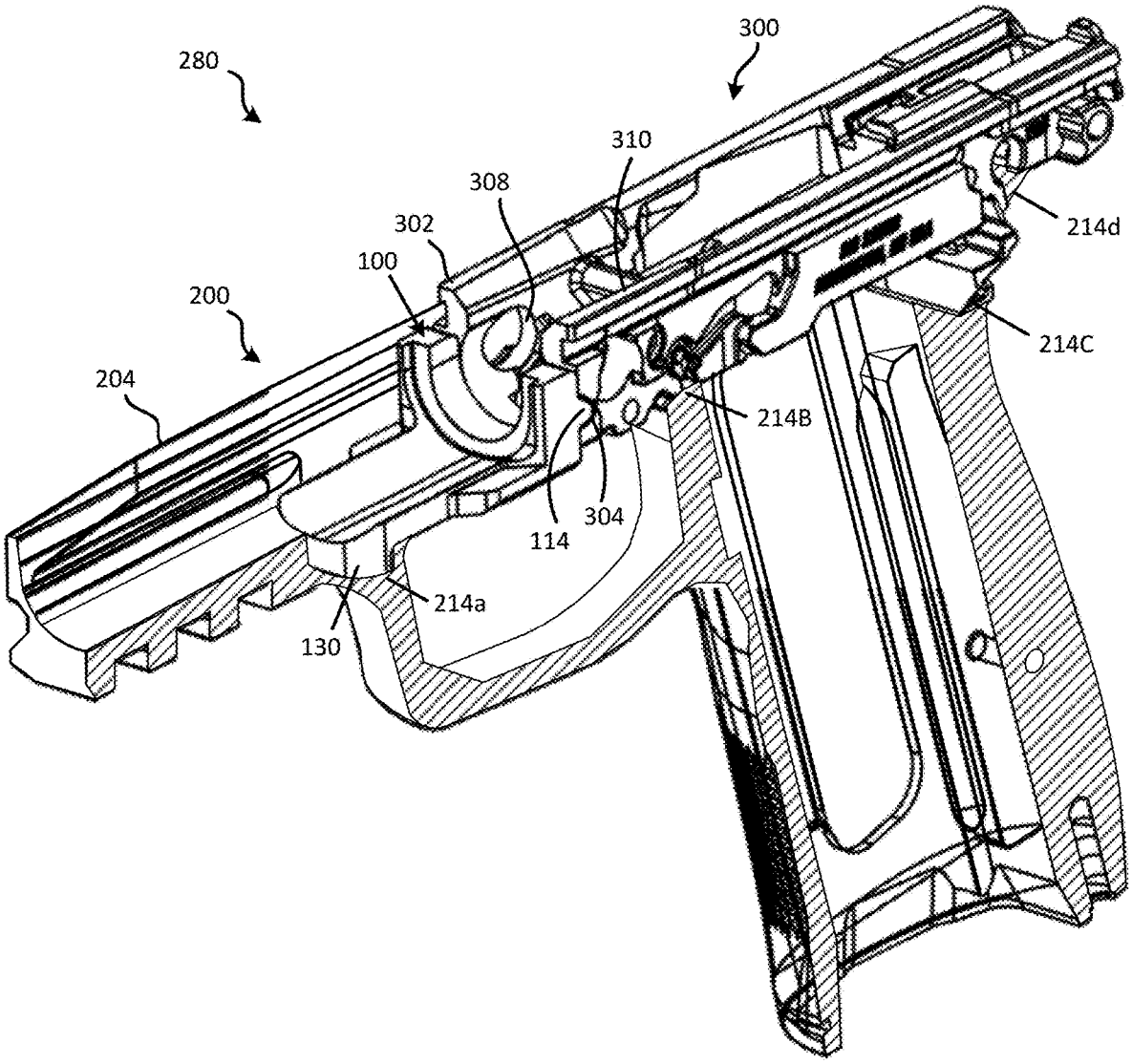
FIG. 9 illustrates a partial cross-sectional and front perspective view of a firearm subassembly showing a recoil bracket and receiver installed in a grip module, which is shown in cross-section, in accordance with an embodiment of the present disclosure.

FIGS. 8 and 9 illustrate a side view and a partial cross-sectional and front perspective view, respectively, of a firearm subassembly 280 with a receiver 300 and recoil bracket 100 installed in a grip module 200, in accordance with an embodiment. In FIG. 8 the grip module 200 is shown in cross section with remaining portions of the module shown as transparent and the receiver is highlighted in green. In FIG. 9, the grip module is shown as transparent to more clearly show the recoil bracket 100 and receiver 300. The proximal face of the recoil bracket 100 abuts the distal end 302 of the receiver 300 with each tooth 114 received in the tooth recess 304. The takedown lever opening 308 and barrel lug 310 are visible.

The foot 130 of the recoil bracket 100 occupies the foot recess 210 in the slide portion 204 of the grip module 200.

The foot 130 makes contact with a load-bearing surface 214*a* during part or all of the firing cycle, in accordance with some embodiments. Note that the foot recess 210 is positioned above where the trigger guard 206 connects with the slide portion 204 of the grip module 200. The recoil lug 100 and receiver 300 transfer recoils forces to the grip module 200 by contact with one or more load bearing surfaces 214*a*, 214*b*, 214*c*, 214*d*, 214*e*.

In use, a recoil bracket 100 that is movably retained in the grip module 200, as variously disclosed herein, can more effectively transfer force and avoid mechanical failure compared to other designs. In accordance with some embodiments, the slide and barrel begin to unlock during the initial phase of the firing cycle. As a result, the receiver 300 is pulled upward by engagement between the barrel and barrel lug 310. Contact between the receiver 300 and the recoil bracket 100 at the teeth 114 results in an upward force on the recoil bracket 100. Wings 106 on the recoil bracket 100 engage the slot or undercut 212 in the grip module 200, pushing the grip module 200 upward. The grip module 200 then applies upward and rearward torque on the operator's wrist. The relatively greater area of contact between the recoil bracket 100 and receiver 300 in this example avoids failure at the tooth 114 and/or the failure at fastener openings in other designs of a recoil bracket.

As the end of the barrel and slide unlock, the receiver 300 is pushed downward by engagement between the barrel and barrel lug 310. As a result, the receiver 300 shifts and applies a downward force on the teeth 114 of the recoil bracket 100. In turn the recoil bracket 100 shifts and the wings 106 apply a downward force on the grip module 200. The grip module 200 then torques the operator's wrist down and forward. In contrast, other designs may fail at the tooth when the steel receiver shifts since the recoil bracket is retained in a fixed position. Also, in other designs that are screwed to the grip module, for example, the recoil bracket may fail due to forces applied at the relatively small area of the fasteners and associated bores.

When the slide impacts and stops on the impact surface 117 of the recoil bracket 100, the recoil bracket 100 is pushed rearward against the receiver 300, moving the receiver 300 rearward. The receiver 300 engages load bearing surfaces 214*b*-214*e* and transfers rearward force to the grip module 200. The grip module 200 torques the operator's wrist upward and rearward. In contrast, other designs may fail because the impact of the slide is transferred directly to the grip module by the bracket rather than being transferred to the receiver and then to the grip module at load bearing surfaces.

When the slide returns forward and stops, the receiver 300 is pushed forward by impact between the barrel and barrel lug 310. The receiver 300 then shifts so that the distal end 302 of the receiver 300 engages the recoil bracket 100, pushing the recoil bracket 100 forward. In turn, the recoil bracket 100 shifts position so that the distal end and/or foot 130 of the recoil bracket engage the grip module 200 and push the grip module 200 forward. The grip module 200 then torques the operator's wrist forward and down. In accordance with the present disclosure, moving the point of impact forward in the grip module 200 increases strain relief and allows the trigger guard 206 to share the load. In contrast, other designs may fail because the grip module is relatively thin near the distal end of the receiver.

FURTHER EXAMPLE EMBODIMENTS

The following examples pertain to further embodiments, from which numerous permutations and configurations will be apparent.

Example 1 is a handgun grip module assembly that includes a grip module with a handgrip portion, a slide portion, and a trigger guard extending between and connecting the handgrip portion to the slide portion. The slide portion extends longitudinally along a central axis and has opposed sidewalls and a bottom wall. The slide portion defines a bracket recess in the bottom wall and defines a receiver well between the opposed sidewalls and above the handgrip portion. A recoil bracket is movably disposed in the bracket recess.

Example 2 includes the assembly of Example 1, wherein the grip module is made primarily or entirely of metal.

Example 3 includes the assembly of Example 1, wherein the grip module is made of aluminum, an aluminum alloy, or a metal-infused polymer. In one such embodiment, the metal-infused polymer includes powder, granules, or regular or irregular blocks of metal, or combinations of such metal forms.

Example 4 includes the assembly of Example 3, wherein the recoil bracket is made of or includes steel, aluminum, an aluminum alloy, titanium, brass, or tungsten.

Example 5 includes the assembly of any one of Examples 1-4, wherein the recoil bracket has a longitudinal portion extending along the central axis, the longitudinal portion received in the bracket recess. The recoil bracket also has a lug portion extending upward from the longitudinal portion, the lug portion defining a U-shaped passageway. A portion of the bracket recess extends upward along the opposed sidewalls, and sides of the lug portion are received in the portion of the bracket recess that extends upward along the opposed sidewalls.

Example 6 includes the assembly of Example 5, wherein the recoil bracket further comprises teeth protruding rearward from the lug portion. For example, sides of the lug portion each have a tooth extending rearward.

Example 7 includes the assembly of Example 6 and further comprises a receiver disposed in the receiver well, where a distal end of the receiver abuts a proximal face of the lug portion, and where the distal end of the receiver defines recesses that receive the teeth on the recoil bracket.

Example 8 includes the assembly of Example 7, wherein the receiver includes fire control components.

Example 9 includes the assembly of any one of Examples 5-8, wherein the recoil bracket includes an eye on a bottom of the longitudinal portion, the eye defining an elongated through opening.

Example 10 includes the assembly of Example 9 and further comprises a retaining pin extending laterally through the slide portion of the grip module and the through opening of the eye.

Example 11 includes the assembly of any one of Examples 5-10, wherein a top surface of the longitudinal portion has an arcuate profile.

Example 12 includes the assembly of Example 11, wherein the top surface of the longitudinal portion is flush or substantially flush with the bottom wall of the slide portion of the grip module.

Example 13 includes the assembly of any one of Examples 5-12, wherein the bracket recess includes a foot recess portion of increased depth, and wherein the recoil bracket includes a foot extending downward from the longitudinal portion and is received in the foot recess portion.

Example 14 includes the assembly of Example 13, wherein the foot is located at a distal end of the longitudinal portion.

Example 15 includes the assembly of any one of Examples 5-14, wherein the grip module defines lateral recesses along part of the opposed sidewalls, and wherein the recoil bracket includes wings extending laterally outward from the longitudinal portion, each of the wings received in one of the lateral recesses.

Example 16 includes the assembly of any one of Examples 1-15, wherein the trigger guard connects to the slide portion of the grip module below the bracket recess.

Example 17 includes the assembly of any one of Examples 1-16, wherein the grip module defines a recoil block between the bracket recess and the receiver well, the recoil block extending up from the bottom wall and abutting or positioned to abut a proximal face of the recoil bracket in use.

Example 18 is a semiautomatic handgun comprising the handgun grip module assembly of any one of Examples 1-17.

Example 19 includes the handgun of Example 18 configured as a compact handgun having a barrel length of not more than four inches. In some embodiments, the barrel length is not more than 3.5 inches or not more than 3.25 inches.

Example 20 includes the semiautomatic handgun of Example 18 or 19, where the handgun is chambered in 9 mm Luger.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

The invention claimed is:

1. A handgun grip module assembly, comprising:

a grip module having a handgrip portion, a slide portion, and a trigger guard extending between and connecting the handgrip portion to the slide portion, wherein the slide portion extends longitudinally along a central axis and has opposed sidewalls and a bottom wall, and wherein the slide portion defines a bracket recess in the bottom wall and defines a receiver well between the opposed sidewalls and above the handgrip portion; and a recoil bracket retained in the bracket recess of the grip module and movable along the central axis.

2. The handgun grip module assembly of claim 1, wherein the grip module is made primarily of metal.

3. The handgun grip module assembly of claim 1, wherein the grip module is made of aluminum, an aluminum alloy, or a metal-infused polymer.

4. The handgun grip module assembly of claim 1, wherein the recoil bracket comprises steel, aluminum, titanium, brass, or tungsten.

5. A handgun grip module assembly, comprising:

a grip module having a handgrip portion, a slide portion, and a trigger guard extending between and connecting the handgrip portion to the slide portion, wherein the slide portion extends longitudinally along a central axis and has opposed sidewalls and a bottom wall, and wherein the slide portion defines a bracket recess in the bottom wall and defines a receiver well between the opposed sidewalls and above the handgrip portion; and a recoil bracket movably retained in the bracket recess of the grip module, the recoil bracket comprising:

a longitudinal portion extending along the central axis, the longitudinal portion received in the bracket recess; and a lug portion extending upward from the longitudinal portion, the lug portion defining a U-shaped passageway;

wherein a portion of the bracket recess extends upward along the opposed sidewalls, and wherein sides of the lug portion are received in the portion of the bracket recess that extends upward along the opposed sidewalls.

6. The handgun grip module assembly of claim 5, wherein the recoil bracket further comprises teeth protruding rearward from the lug portion.

7. The handgun grip module assembly of claim 6, further comprising a receiver disposed in the receiver well, a distal end of the receiver abutting a proximal face of the lug portion, wherein the distal end of the receiver defines recesses receiving the teeth on the recoil bracket.

8. The handgun grip module assembly of claim 7, wherein the receiver includes fire control components.

9. The handgun grip module assembly of claim 7, wherein the recoil bracket includes a protrusion extending away from a bottom of the longitudinal portion, the protrusion defining an elongated opening extending crosswise through the protrusion.

10. The handgun grip module assembly of claim 9, further comprising a retaining pin extending laterally through the grip module and the elongated opening through the protrusion.

11. The handgun grip module assembly of claim 5, wherein a top surface of the longitudinal portion has an arcuate profile.

12. The handgun grip module assembly of claim 11, wherein the top surface of the longitudinal portion is at least substantially flush with the bottom wall of the slide portion of the grip module.

13. The handgun grip module assembly of claim 5, wherein the bracket recess includes a foot recess of increased depth, and wherein the recoil bracket includes a foot extending downward from the longitudinal portion and received in the foot recess.

14. The handgun grip module assembly of claim 13, wherein the foot is located at a distal end of the longitudinal portion.

15. The handgun grip module assembly of claim 5, wherein the grip module defines lateral recesses along part of the opposed sidewalls, and wherein the recoil bracket includes wings extending laterally outward from the longitudinal portion, each of the wings received in one of the lateral recesses.

16. The handgun grip module assembly of claim 1, wherein the trigger guard connects to the slide portion of the grip module below the bracket recess.

17. The handgun grip module assembly of claim 1, wherein the grip module defines a recoil block between the bracket recess and the receiver well, the recoil block extending up from the bottom wall and abutting or positioned to abut a proximal face of the recoil bracket in use.

18. A semiautomatic handgun comprising the handgun grip module assembly of claim 1.

19. The handgun grip module assembly of claim 1, further comprising:

a fastener arranged to retain the recoil bracket in the grip module;

wherein the recoil bracket defines an opening elongated along the central axis, and wherein the fastener extends through the opening.

20. The handgun grip module assembly of claim 19, wherein the fastener is a pin.

* * * * *